US005397880A

United States Patent [19]

Georgilis

[11] Patent Number: 5,397,880

[45] Date of Patent: Mar. 14, 1995

[54] TAXI METER

[76] Inventor: Steven Georgilis, 37-22 59th St., Woodside, N.Y. 11377

[21] Appl. No.: 130,759

[22] Filed: Oct. 4, 1993

[51] Int. Cl.[6] ..... G07B 15/00

[52] U.S. Cl. ..... 235/33; 235/30 R; 235/45

[58] Field of Search ..... 235/33, 31 R, 30 R, 235/31 T, 29 A, 30 A, 44, 45; 400/621, 690.4

[56] References Cited

U.S. PATENT DOCUMENTS

| | | | |
|---|---|---|---|
| 1,143,424 | 6/1915 | Meyer | 235/31 R |
| 1,986,185 | 1/1935 | Coil | 235/30 R |
| 3,052,403 | 9/1962 | Damon | 235/1 D |
| 4,451,167 | 5/1984 | Honma et al. | 400/621 |
| 4,592,669 | 6/1986 | Lohse et al. | 400/621 |
| 5,274,561 | 12/1993 | Adams et al. | 235/30 R |

FOREIGN PATENT DOCUMENTS

| | | | |
|---|---|---|---|
| 2817582 | 11/1978 | Germany | 235/30 A |
| 3139203 | 4/1983 | Germany | 235/30 R |
| 0222074 | 12/1923 | United Kingdom | 235/30 K |

*Primary Examiner*—Howard B. Blankenship

*Assistant Examiner*—Eddie C. Lee

*Attorney, Agent, or Firm*—Marvin Feldman

[57] ABSTRACT

An improved taxi meter construction is constructed of the following features: (1) an extrusion piece sideways reciprocal movement mount for the electrical and mechanical connection and disconnection without damage to the connection elements, (2) a detachable receipt paper cutter plate for ready access, maintenance and repair of the paper supply means, and (3) an extrusion piece hinged door for access to the receipt paper supply means for replenishment of the paper supply. The improved construction results from each of these features, as well as in the combination of these features. The taxi meter housing is of low cost extruded aluminum components. The taxi meter housing encases the operating elements in a tamper-proof housing, while permitting ready access to the mechanical features such as the fare receipt paper supply means, the fare printer and the receipt paper cutter plate. This improved taxi meter construction provides a low cost, and yet tamper-proof construction, with minimal maintenance and downtime from in-service use.

16 Claims, 3 Drawing Sheets

TAXI METER

FIELD OF THE INVENTION

This invention relates to taxi meters. Specifically this invention relates to improvements in certain construction elements and features of taxi meters.

BACKGROUND OF THE INVENTION AND DISCUSSION OF THE PRIOR ART

In the construction of taxi meters it was important to provide a durable and tamper-proof construction. This type of construction was necessary in order to insure that the fare charged to the passenger was accurate and in accordance with the regulated fare as calibrated in the meter.

To achieve this result, the art was directed to providing the construction features and elements fully encased within a heavy duty housing. Many of the housing features were of cast and machined metal construction. While such constructions were generally tamper-proof, the heavy duty construction and encasement was costly, cumbersome and caused disrepair to the meter electrical connectors. Disassembly, maintenance and repair of the encased elements was excessively time consuming and unduly costly. Typical causes of disrepair and maintenance were; (1) the damage to the meter electrical connector by repeated removal (usually by lifting) and replacement of the meter for repair, maintenance or fare calibration, and (2) the jamming of the fare receipt paper of the paper feeder which required disassembly of the meter for access to the paper feeder. A costly and cumbersome construction feature was a machined parts hinged door for the access to and regular replenishment of the fare receipt paper.

OBJECTS OF THE PRESENT INVENTION

It is an object of the present invention to provide a taxi meter which is durable and tamper-proof and yet minimizes the costs of and need for undue repair and maintenance of several mechanical features or components, particularly including; (1) the electrical connector (2) the fare receipt paper cutter, and (3) the fare receipt paper supply access means.

It is a further object of the present invention to provide a taxi meter as aforesaid in which the construction, manufacture and assembly are readily achieved utilizing several extruded metal elements, and yet the meter is durable, tamper-proof and practical in design and use.

SUMMARY OF THE INVENTION

A taxi meter is provided with, individual and in combination, construction elements and features namely; (1) housing mounting supporting elements for sideways housing movement with concomitant connection and disconnection of the meter electrical connector without damaging the connector, (2) a fare receipt paper cutter plate disconnectably connected to the outside of the meter housing for selective access to the paper feeder when the paper is jammed, and (3) an access door of simplified design and formed with a specifically contoured edge and surface for cooperative sliding movement with a specifically contoured housing edge surface to open and close the door for access to the fare receipt paper supply for replenishment of the paper.

DESCRIPTION OF THE PREFERRED EMBODIMENTS

Figure 1:
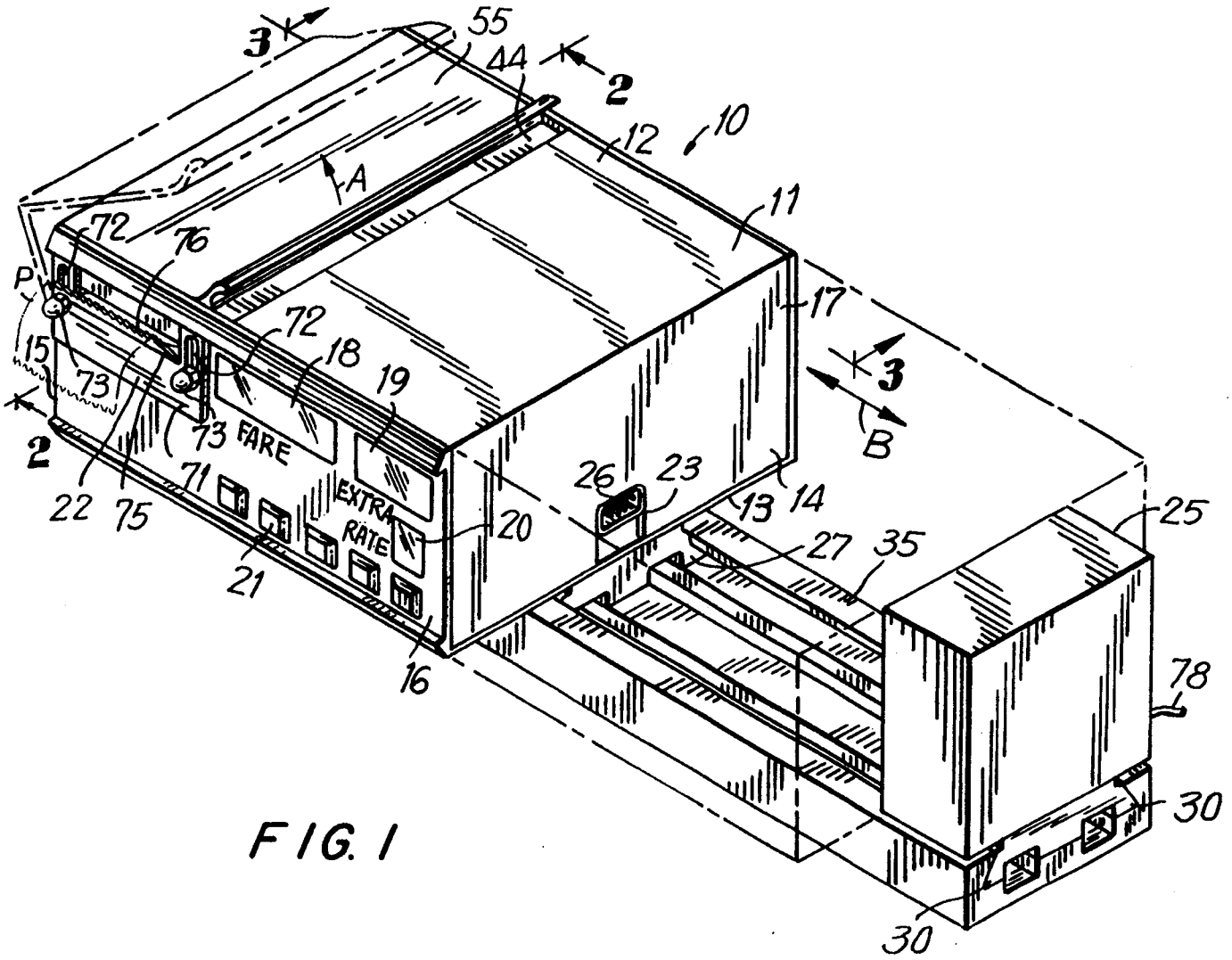
FIG. 1 is a perspective view of the taxi meter, and in broken line view there is shown the sideways movement of the meter for connection and disconnection, and the opening of the access door to access the fare receipt paper supply means.

Referring to the FIGS, there is shown the taxi meter 10 of the present invention. Taxi meter 10 is formed of housing 11 having a top 12 and bottom 13, oppositely disposed sides 14 and 15, a front 16 and back 17. Front 16 is provided with the digital display windows 18, 19 and 20 for visual display of the fare information. Front 16 is also provided with a series of manually operated buttons 21 (typical) for "on-off", "paper feed", "print", and like functions. A paper cutter plate assembly 22 is mounted to front 16 as will be more fully discussed hereinafter.

Figure 2:
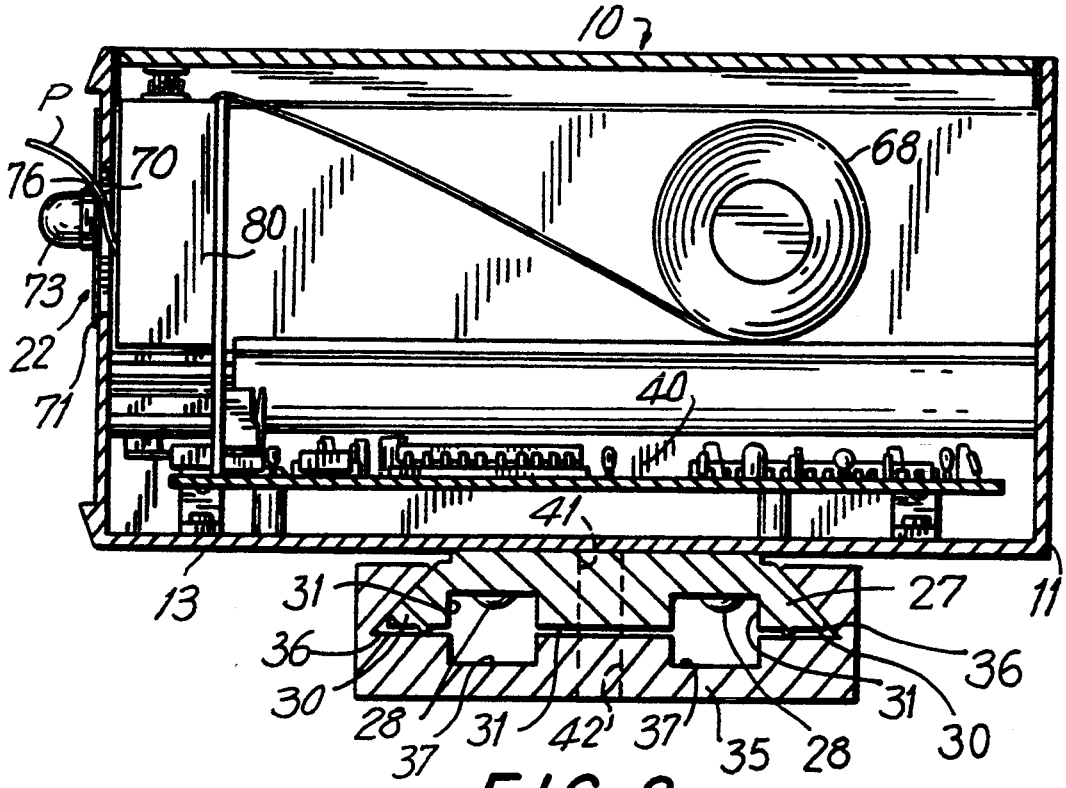
FIG. 2 is an enlarged sectional view taken along line 2—2 of FIG. 1.

An electrical connector 23 is mounted at and recessed within housing side 14 (FIG.1), and a mating connector 24 (FIG.4) is fixedly connected to fare information inputting unit 25. Connector 23 is formed with electrical connection prongs 26 which must be protected from disrepair or misalignment. An extuded member 27 is fixedly connected by bolts 28 to the bottom 13 of housing 11. Member 27 is formed with outwardly extending wings or tongues 30 which extend the length of member 27. Member 27 is also formed with a bottom surface 31 and rectilinear cut-out portions 31. An extuded member 35 is fixedly bolted to the fare information inputing unit 25 by bolts (not shown) in a manner similar to that of bolts 28. Member 35 is, as best shown in FIG. 2, formed with grooves 36 extending the length of the member 35. A pair of cutout portions 37 extends the length of member 35. The tongues 30 of member 27 are slidably received within the grooves 36 of member 35 for reciprocal movement. In this manner of construction, meter 10 can be moved from side to side by this reciprocal sliding action (arrow 13 of FIG. 1). When meter 10 is moved fully in the direction of unit 25, the connector 24 of unit 25 fits into and connects with the connector 23 of meter 10 and the electrical connection is thereby completed between the fare information inputing unit 25 and the electrical circuit means or fare computation circuitry 40 contained within meter housing 11. The prongs 26 of connector 23, during connection and disconnection, are fully protected from damage or misalignment by this construction. Meter 10 is fully supported during connection and disconnection.

With the electrical connection completed, the meter 10 is operational, and should not be subject to unauthorized removal or tampering. A sealed lock (not shown) is mounted through coincident through holes 41 and 42 of members 27 and 35, respectively, to prevent unauthorized removal of the meter (FIG. 2).

Figure 3:
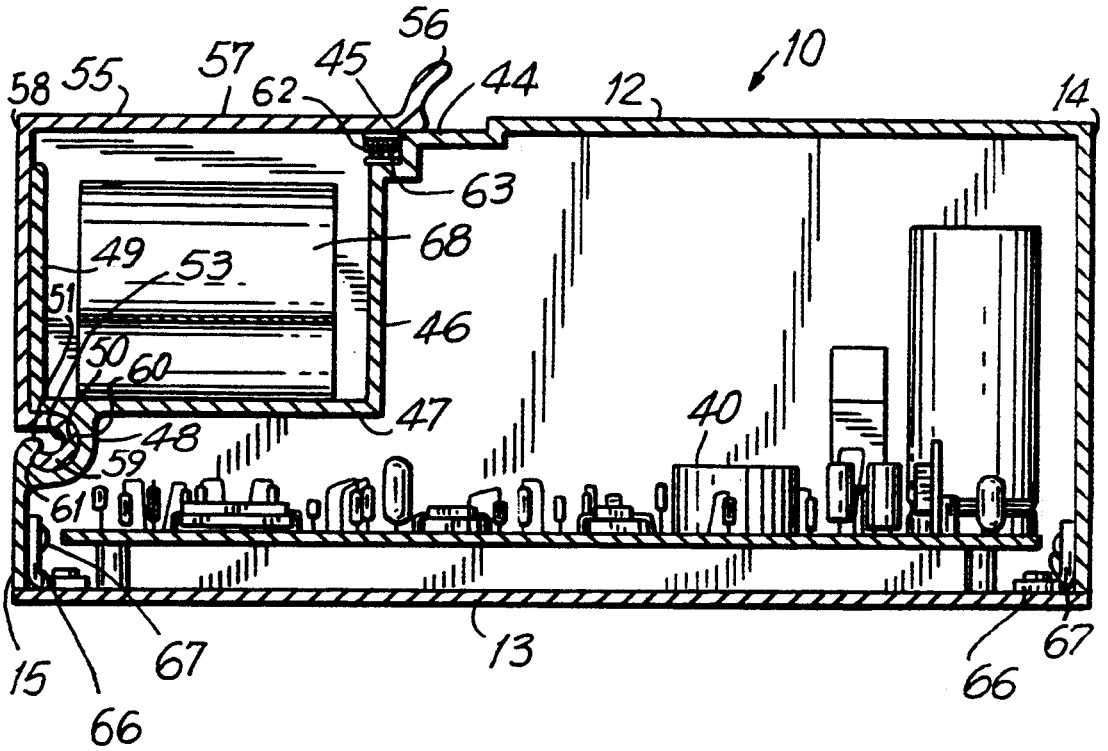
FIG. 3 is an enlarged sectional view taken along line 3—3 of FIG. 1.

Housing 11 is integrally formed with wall section 44 which extends from the top 12 to side 15 (FIG. 3). Wall section 44 is formed of step portion 45, vertical barrier or wall 46, horizontal wall 47, and transition wall portion 48, which in turn forms vertical wall 49 and housing side 15. Wall portion 48 is formed with a U-shaped recess 50 and a lip or overhang portion 51 which extends upwardly and inwardly from portion 48 and side 15, for purposes hereinafter appearing.

An access door is formed of a one-piece generally L-shaped extuded member 55. Member 55 is formed with, at one end, a wing 56 for engagement by the fingers of the user, a top portion 57, side portion 58, and a U-shaped lower portion 59, having U-shaped recess surface 53 and outer surface 60, and terminating with end edge 61. Surface 60 is contoured to slidably move within recess 50, and edge 61 abuts and is retained by lip 51 (FIG. 3) with door 54 closed on housing 11. Convention lock elements composed of interengaging prongs 62 and 63 are fixedly connected on top portion 57 and step portion 45, respectively, to hold door 54 closed. To open the door, the user lifts wing 56 and moves the door in the direction of arrow A (FIG. 1). In this manner, surface 60 moves within recess 50 and lip 51 and then contacts the U-shaped recess surface 53 when the door is in the fully opened position.

A fare receipt paper supply or feeder 63 and a fare receipt information printer 40, of conventional design and construction well known in the art, are mounted on wall 47, disposed between opposed walls 46 and 49. In this manner, when the door is open, the user readily accesses the paper feeder 63 and printer 80 without being able to access or tamper with the fare computation circuitry 40 fully contained within the housing. In this regard it is important to note that housing parts including the top and sides are internally connected by brackets 66 and bolts 67 to the bottom 13 to further provide a secure tamper-proof construction.

The fare information is printed on the paper P by printer 80 and then fed forwardly through rectangular opening 70 in housing front 16 to paper cutter assembly 22. Assembly 22 is formed of plate 71 having a pair of elongated vertically disposed slots 72, and a pair of screw members or connectors 73 which selectively connect plate 71 through screw holes (not shown) in and to front 16. A cutter plate 75 is formed from and angularly disposed with respect to plate 71. A serrated edge 76 is formed on plate 75, which edge 76 is spaced upwardly and forwardly from opening 70. In this manner, the printed paper P slidably passes through opening 70 and then slides upwardly on plate 75 and over serrated edge 76 (FIG. 1) to be cut off at the top by the serrated edge. In this manner, jamming is minimized, and in the event jamming does occur, the user simply removes the plate by unscrewing connectors 73, and frees the jammed paper from the printer 80.

Figure 4:
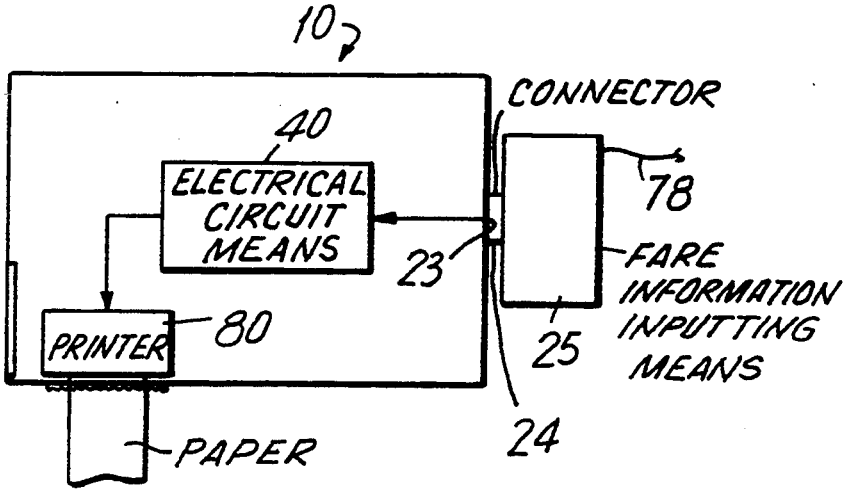
FIG. 4 is a schematic view of the taxi meter.

Referring to FIG.4, the schematic arrangement of the operation of the taxi meter is shown. The fare information is received initially from an electrical cable 78 connected to fare information inputting unit 25, and through connectors 23 and 24 to the electrical circuit means or fare computation circuitry 40 to printer 80. It is important to note that the fare information inputting, computation and printing mechanisms and circuitry may be of conventional design and construction, which are well known to those skilled in the art.

By the aforesaid manner of construction, the user can remove the meter by merely removing the lock (not shown) from the mounting bracket, and sliding the meter sideways and thereby disconnecting the electrical connectors. The sideways movement, while the meter remains supported and aligned, permits disconnection without damage to the electrical connector prongs. Reconnection of the meter is similarly achieved without damage to the electrical connector.

The aforesaid construction permits the user to replenish the paper simply by opening the access door. Access to the paper supply is achieved without having to break any seals or unlock any locks, and yet the fare computation circuitry remains intact and undisturbed.

When the printed fare receipt paper is jammed, the user can simply disconnect the cutter plate and gain access to the jammed paper, without having to disturb the integrity of the fare computation circuitry.

It is important to note that by virtue of the present design and construction, the housing may be constructed of extuded aluminum plates, and the mounting members may be of extuded aluminum as well, thereby minimizing the need for heavy duty cast and machined steel components.

Although the present invention has been described with reference to particular embodiments, it is to be appreciated that various adaptations and modifications may be made and the invention is only to be limited by the appended claims.

What I claim is:

1. A taxi meter comprising, housing means, means for feeding fare receipt paper operably mounted in said housing means, cutter plate means for permitting the fare receipt paper to be cut free, said cutter plate means being disposed on the housing means, and means for disconnectably connecting the cutter plate means to the housing means for access to the means for feeding the fare receipt paper, said cutter plate means comprising means for cutting said paper disposed on said housing means adjacent said means for feeding said paper, said cutter plate means comprising a cutter plate being formed with an opening sized to slidably receive said paper, and wherein said means for cutting said paper comprises a serrated edge disposed at said opening, and wherein said cutter plate and said housing means comprise said means for disconnectably connecting the cutter plate from the housing means, said cutter plate comprising a flange portion in angular disposition to the cutter plate means, and said flange portion comprises said serrated edge, whereby the paper is disposed on said flange portion in said opening.

2. The taxi meter of claim 1, said means for connecting the cutter plate means comprising cooperative elements disposed respectively on the housing means and the plate means, said elements being formed to be selectively engaged and disengaged.

3. The taxi meter of claim 2, said housing means being formed with an opening, said housing means opening and said plate means opening being aligned so that said printed fare receipt paper is slidably disposed through both said openings.

4. The taxi meter of claim 3, further comprising electrical circuit means for determining a taxi fare, said circuit means disposed within said housing means, and means for printing fare receipt information on the paper, said printing means being operably connected to the electrical circuit means.

5. The taxi meter of claim 1, said housing means comprising opposed sides, electrical circuit means for determining a taxi fare, said electrical circuit means disposed within said housing means, and means for inputing fare information, and means for electrically operably connecting said fare information inputing means to said circuit means, and means for mounting said housing means so that said housing means is disposed for said connecting said circuit means to said fare information inputing means, and wherein said means for mounting said housing means comprises elongated means for horizontally supporting and reciprocally moving the housing means in the directions of one opposed side to the other opposed side, so that with said reciprocal movement there is alternatively a horizontal sideways connection and disconnection of said fare information inputing means with said electrical circuit means.

6. The taxi meter of claim 5, further comprising, means for feeding fare receipt paper operably disposed within said housing means, means for accessing said means for feeding said paper disposed on said housing means, and means for moving said means for accessing relative to said housing means to open and close said means for accessing to selectively access said means for feeding said fare receipt paper.

7. The taxi meter of claim 6, said housing means further comprising wall means for fully separating said paper feeding means from said circuit means, said wall means comprising means to fully enclose said circuit means to prevent access to said circuit means while said means for accessing said means for feeding said fare receipt paper permits selective access to said means for feeding said fare receipt paper.

8. A taxi meter comprising, housing means, said housing means comprising opposed sides, electrical circuit means for determining a taxi fare, said circuit means disposed within said housing means, and means for inputing fare information, and means for electrically operably connecting said fare information inputing means to said circuit means, and means for mounting said housing means so that housing means is disposed for said connecting of said circuit means to said fare information inputing means, and wherein said means for mounting said housing means comprises means for reciprocal horizontal movement in the directions of one opposed side to the other opposed side, so that with said reciprocal movement there is alternatively, a connection and disconnection of said fare information inputing means with said electrical circuit means, said means for mounting said housing means comprising oppositely disposed elongated plate means, means to fixedly mount said fare information inputing means to one said plate means, means to fixedly mount said housing means on the other plate means, and said oppositely disposed elongated plate means being formed with respective means for reciprocal horizontal sliding movement of the housing means relative to the fare information inputing means for connection and disconnection of said electrical circuit means, said plate means comprising means for supportably mounting said housing means on the one said plate means, whereby with said reciprocal sliding movement of the housing means, the housing means is supported on the one said plate means.

9. The taxi meter of claim 8, said means for connecting said fare information inputing means to said circuit means being disposed at one of said housing sides.

10. The taxi meter of claim 8, said oppositely disposed plate means comprising tongue and groove means for said reciprocal sliding movement of the housing means with said supported mounting of said housing means on said one said plate means.

11. A taxi meter comprising, housing means, means for feeding fare receipt paper operably disposed within said housing means, means for accessing said means for feeding said paper disposed on said housing means, and means for moving said accessing means relative to said housing means to access said means for feeding said fare receipt paper, said means for accessing comprising cover plate means, and said housing means being formed with a recess contoured to cooperatively slidably receive said cover plate means, said cover plate means having edge means, and said housing means having lip means formed to retain said cover plate edge means, whereby with manual movement of said cover plate means, said cover plate edge means slidably moves relative to said housing recess lip means to open and close said means for accessing to provide selective access to said means for feeding fare receipt paper.

12. The taxi meter of claim 11, said plate surface being U-shaped and said housing recess being U-shaped.

13. The taxi meter of claim 12, said housing consisting of a one piece construction.

14. The taxi meter of claim 11, further comprising electrical circuit means for determining a taxi fare, said circuit means disposed within said housing means, with said printing means being operably connected to the circuit means.

15. The taxi meter of claim 14, said housing means further comprising means enclosing said electrical circuit means, said housing means further comprising wall means separating said means for feeding fare receipt paper from said circuit means, said wall means further comprising means for fully enclosing said circuit means, whereby access to said circuit means is prevented, and said cover plate means provides selective access to said means for feeding fare receipt paper.

16. The taxi meter of claim 11, said plate portion being disposed to form a corner, said housing being formed with a corner, and said plate corner being coincident with said housing corner when the means for accessing is closed on said housing.

* * * * *